US006966461B2

(12) United States Patent
Warner et al.

(10) Patent No.: US 6,966,461 B2
(45) Date of Patent: Nov. 22, 2005

(54) APPARATUS FOR MOUNTING A SPRAY CAN

(76) Inventors: Norris E. Warner, 719 Oak Hills Rd., Pipe Creek, TX (US) 78063; Norris E. Warner, II, 797 Oak Hills Rd., Pipe Creek, TX (US) 78063

( * ) Notice: Subject to any disclaimer, the term of this patent is extended or adjusted under 35 U.S.C. 154(b) by 14 days.

(21) Appl. No.: 10/796,688

(22) Filed: Mar. 9, 2004

(65) Prior Publication Data

US 2005/0199653 A1 Sep. 15, 2005

(51) Int. Cl.[7] ..... B67D 5/64

(52) U.S. Cl. ..... 222/174; 222/191; 222/402.15; 222/473

(58) Field of Search ..... 222/174, 473, 222/402.1–402.25, 474, 191; 248/310, 311.2, 248/128, 133, 291.1, 316.1

(56) References Cited

U.S. PATENT DOCUMENTS 3,017,056 A * 1/1962 Bishop ..... 222/164
3,039,657 A * 6/1962 Meuwly ..... 222/174
3,485,206 A * 12/1969 Smrt ..... 118/305
3,716,195 A * 2/1973 Silva ..... 239/375
3,856,209 A * 12/1974 Hickson ..... 239/532
3,861,566 A * 1/1975 Wentzell ..... 222/174
4,089,440 A * 5/1978 Lee ..... 222/174
4,099,482 A * 7/1978 Smrt ..... 118/712
4,886,191 A * 12/1989 Yoshitomi ..... 222/174
5,307,959 A * 5/1994 Bedore et al. ..... 222/174
6,390,336 B1 * 5/2002 Orozco ..... 222/162
6,789,705 B2 * 9/2004 Drew ..... 222/174

* cited by examiner

*Primary Examiner*—Frederick C. Nicolas
(74) *Attorney, Agent, or Firm*—Christopher L. Makay

(57) ABSTRACT

An apparatus for mounting an aerosol spray can such that the can may be activated to dispense product from the can at a remote location to the user. The apparatus has a handle, a can base support, a body member and a trigger lever. The lever is pivotably attached to the body member such that it moves a trigger hammer to engage and depress the can push-button to discharge the contents of the pressurized can. The lever has first and second arms disposed at an angle in the range of 91° to 101°.

7 Claims, 2 Drawing Sheets

APPARATUS FOR MOUNTING A SPRAY CAN

FIELD OF THE INVENTION

The present invention relates to a spray gun with an extendable member for enabling the user to spray objects at an elevated height or at a distant position from the user. While the present invention may be used to spray any object, a particular embodiment discussed herewith relates to an apparatus for spraying wounds on trees caused by pruning or other maintenance.

It should be understood that the present apparatus could be utilized to spray paints, cleaners, nutrients, insecticide, herbicide, or any product housed in an aerosol can having a spray activator push button.

BACKGROUND OF THE INVENTION

When a tree is pruned by having a branch cut, an exposed wound is left behind. Left untreated, the exposed wound leaves the tree vulnerable to invasion by insects and infection by diseases such as Oak Wilt. To prevent this harm to the tree, the wound must be sealed.

One method of sealing exposed tree wounds is through the use of a spray tree wound sealant. A representative product of this type is Treekote Aerosol Wound Dressing which is provided in a 12 ounce push-button spray can.

While simple and efficient to use, the utility of wound dressings of this sort is limited by the requirement that the user must be relatively close to the tree wound in order to apply the dressing. For tall trees this involves either the use of a ladder or a lift bucket. Both of which add to the risk and expense of applying wound dressing.

Applicant's invention provides a manner of applying wound dressing to a tree wound from the safety of the ground without the time-consuming process of climbing a ladder or being lifted in a bucket. Again, it should be understood that any product housed in an aerosol spray can with a push-button activator may be mounted to the present invention to provide the extension needed.

SUMMARY OF THE INVENTION

The present invention consists of a spray gun apparatus that cradles an aerosol can and is adapted to accept a telescoping extension pole to elevate the aerosol can and still allow the user to activate the sprayer push-button more remotely.

A rope, cable, or other similar article is attached to a trigger lever adapted to the spray gun to allow a user standing on the ground to depress the button while the can is extended outwardly or upwardly at the end of an extension pole. When the rope is pulled toward the user, a trigger lever engages a trigger yoke which depresses the spraying mechanism of the aerosol can which dispenses the product at the remote location. When the rope is released, the spraying action terminates. The rope and the extension pole are maintained in a generally parallel relationship by the angle of the lever mechanism.

BRIEF DESCRIPTION OF THE PREFERRED EMBODIMENT

DETAILED DESCRIPTION OF THE PREFERRED EMBODIMENT

Figure 1:
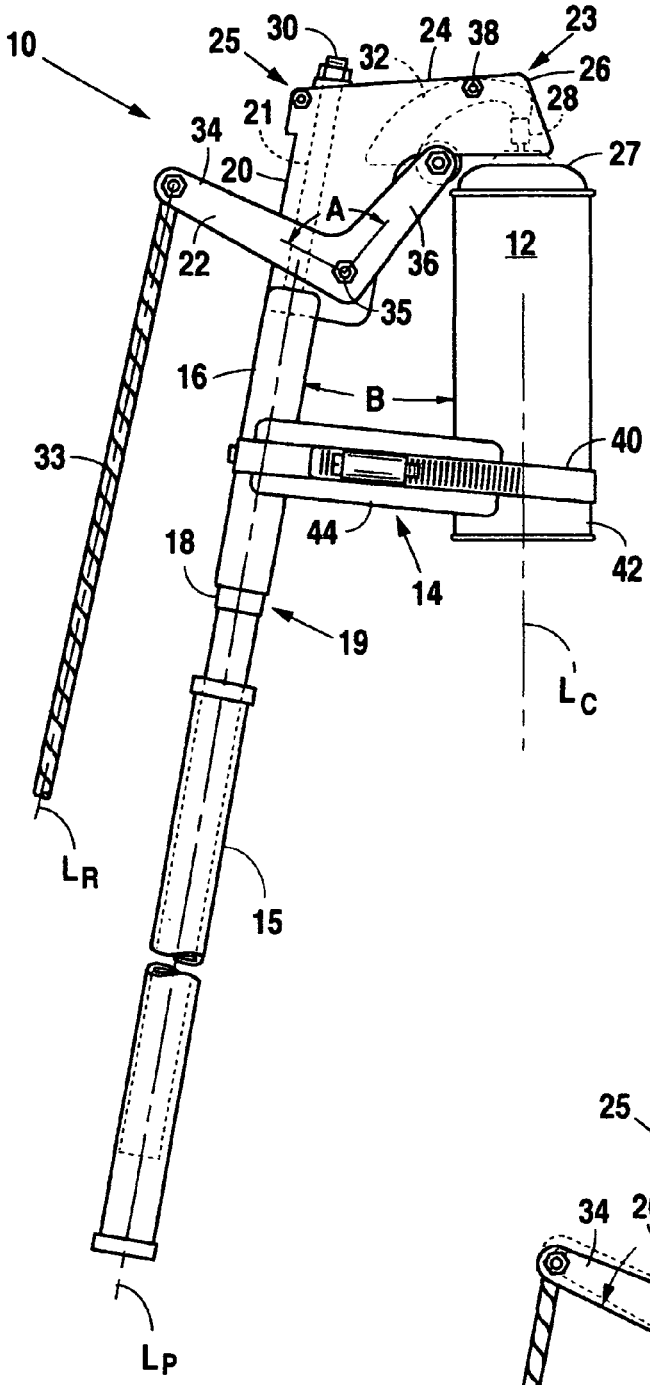
FIG. 1 is a side elevation view of an embodiment of the invention.

Referring to FIGS. 1–4, the present apparatus 10 for extending an aerosol spray can 12 to a remote location may be seen. As seen in FIG. 1, the apparatus 10 includes a can base support 14 attached to a generally vertical handle section 16. The handle 16 has a coupling 18 at a first end 19 for connection to a telescoping pole 15. The other end 21 is attached to an upper support member or body 20. The upper support member 20 supports the pivotable trigger lever 22 and the trigger yoke 24. One end 23 of the yoke 24 provides an upper clamping member 26 for securing the top 27 of the aerosol can 12 with the can's spray push-button 28 between opposite sides (63 and 65) (FIG. 3) of the yoke 24. The other end 25 of the yoke is attached to an extension end 21 of the handle 16. It should be understood that the upper support member 20 including the trigger yoke 24 may be one unitary piece.

Figure 2:
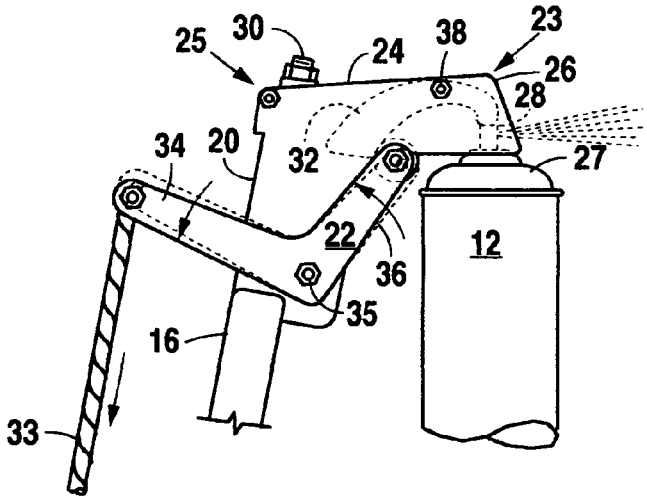
FIG. 2 is a detailed side view of the embodiment of FIG. 1 showing the trigger lever pivoted and engaged with the trigger yoke while the yoke stabilizes the top of the aerosol can and the trigger hammer depresses the push button.
Figure 3:
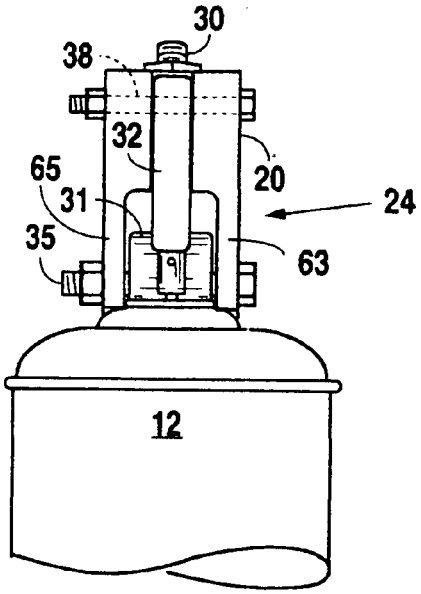
FIG. 3 is a detailed front elevation view of the present invention showing the spray actuator within the yoke engaged with the spray button of the aerosol can.

FIG. 2 illustrates a detailed view of the trigger lever 22 pivotably attached to support 20 and engaging the trigger hammer 32 within the yoke. When a rope, cable, cord, or the like 33 attached to a first arm 34 of lever 22 is pulled, the lever 22 pivots about pivot point 35, moving the second arm 36 of the lever in a generally perpendicular direction to the direction of pull. As the second arm 36 moves, it engages the trigger hammer 32 rotating it to depress the can's push-button 28 thereby dispensing the product from the pressurized aerosol can 12 (FIG. 2). Releasing the rope 33 allows the lever 22 to pivot oppositely and the hammer 32 retracts, the push-button is allowed to extend and close, stopping the dispensing of product. A spring mechanism (not shown) may be used to assist in movement to the retract position.

It has been found that the angle of the lever arms 34 and 36 should be slightly greater than 90° for the most effective operation of the apparatus 10. A range of 91°–101° is the preferred range with the lower portion of the range (91°–93°) being most preferred. Because the angle of the rope pull changes as the apparatus is extended more remotely, having the lever angle at or less than 90° results in greater effort to pivot the lever 22 and move the hammer 32. The closer to parallel that the longitudinal axis $L_R$ of the rope 33 and the longitudinal axis of the $L_P$ of the pole 15 are kept the more efficient the operation of the apparatus.

Figure 4A:
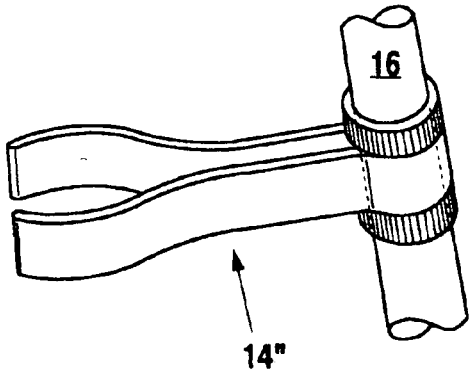
FIG. 4A is a perspective view of yet another base support embodiment (molded) attached to the handle.
Figure 4:
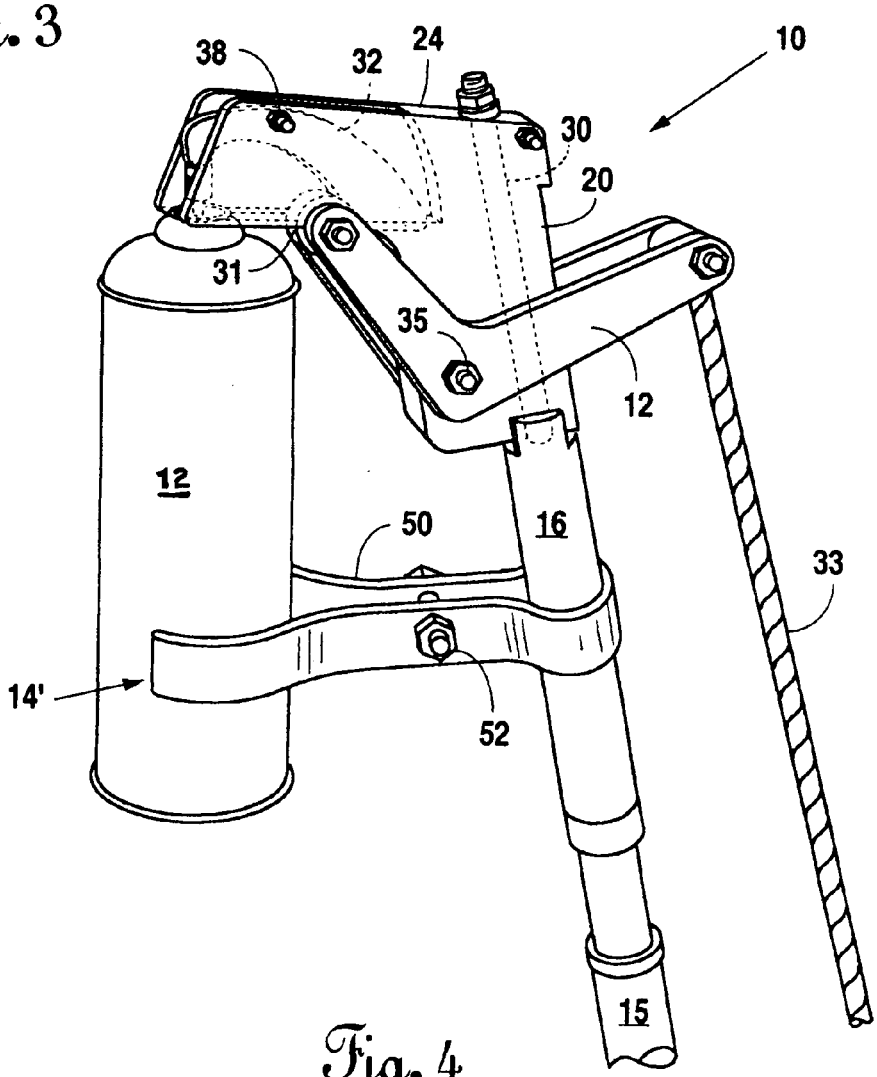
FIG. 4 is a side perspective view of the present invention showing an alternative embodiment of the base support.

The can base support 14 is shown in three embodiments. FIG. 1 illustrates the support 14 as an adjustable strap 40 extending between the handle 16 and the bottom 42 of the can. A resilient space 44 maintains the proper alignment and orientation of the can 12 relative to the upper clamping member 26. FIG. 4 illustrates an alternative support 14' which has opposing arms 50 and 52 affixed to the handle 16. Arms 50 and 52 are flexible such that they may be urged apart to insert the can and then clamp tightly around the can base to hold the can. At least 60 percent of the outer circumference of the can is clamped by arms 50 and 52. FIG.

4A shows a unitary molded base 14" with resilient arms that slide up and down the handle 16.

Although the invention has been described with reference to specific embodiments, this description is not meant to be construed in a limited sense. Various modifications of the disclosed embodiments, as well as alternative embodiments of the inventions will become apparent to persons skilled in the art upon the reference to the description of the invention. It is, therefore, contemplated that the appended claims will cover such modifications that fall within the scope of the invention.

What is claimed is:

1. An apparatus for mounting an aerosol spray can having a push-button, comprising:

a handle having a first coupling end and a second end;

a body member attached to the second end of the handle;

a trigger lever pivotably attached to the body member, the trigger lever having a first arm and a second arm;

a trigger yoke attached to the body member;

a trigger hammer pivotably supported by the trigger yoke, the trigger hammer having a first end and a second end;

a can base support attached to the handle, wherein the can base support holds the aerosol spray can such that the push-button of the aerosol spray can is located beneath the second end of the trigger hammer; and an actuator member attached to the first arm of the trigger lever, wherein movement of the actuator member pivots the trigger lever such that the second arm of the trigger lever engages the first end of the trigger hammer, and further wherein the trigger lever rotates the trigger hammer such that the second end of the trigger hammer travels downward and depresses the push-button of the aerosol spray can.

2. The apparatus of claim 1 further comprising an extension pole connectable to the first coupling end of the handle.

3. The apparatus of claim 1 wherein the first arm and the second arm are disposed at an angle in the range of 91°–101°.

4. The apparatus of claim 1 wherein the first arm and the second arm are disposed at an angle of 91°.

5. The apparatus of claim 1 wherein the can base support comprises first and second spaced apart resilient arms attached to the handle and adapted to contact at least 60 percent of the outer circumference of the aerosol spray can.

6. The apparatus of claim 1 wherein the actuator member is a rope, cable or cord.

7. The apparatus of claim 1 wherein the trigger hammer is disposed within the trigger yoke.

* * * * *